United States Patent [19]

Koizumi et al.

[11] Patent Number: 4,693,952

[45] Date of Patent: Sep. 15, 1987

[54] TONER FOR DEVELOPING ELECTROSTATIC LATENT IMAGE

[75] Inventors: Fumio Koizumi, Hachioji; Takahira Kasuya, Hino; Jiro Takahashi, Sagamihara, all of Japan

[73] Assignee: Konishiroku Photo Industry Co., Ltd., Tokyo

[21] Appl. No.: 736,705

[22] Filed: May 22, 1985

[30] Foreign Application Priority Data

May 22, 1984 [JP] Japan ..... 59-101815
May 22, 1984 [JP] Japan ..... 59-101817
May 22, 1984 [JP] Japan ..... 59-101818

[51] Int. Cl.[4] ..... G03G 9/08
[52] U.S. Cl. ..... 430/109; 430/110
[58] Field of Search ..... 430/109, 110, 114

[56] References Cited

U.S. PATENT DOCUMENTS 3,907,695 9/1975 Amidon et al. ..... 430/115
4,415,644 11/1983 Tamaki et al. ..... 430/109
4,535,048 8/1985 Inoue et al. ..... 430/110

*Primary Examiner*—John L. Goodrow
*Attorney, Agent, or Firm*—Frishauf, Holtz, Goodman & Woodward

[57] ABSTRACT

Toner for developing an electrostatic latent image comprising (a) a polyester resin obtained by polymerizing a composition containing an alcohol and a carboxylic acid, at least one of said alcohol and carboxylic acid containing multifunctional component of not less than tri-valents and (b) an epoxy resin.

13 Claims, No Drawings

TONER FOR DEVELOPING ELECTROSTATIC LATENT IMAGE

FIELD OF THE INVENTION

The present invention relates to a toner for developing an electrostatic latent image or an electromagnetic latent image.

BACKGROUND OF THE INVENTION

Recently a means for obtaining a visualized image from a given image information based on an electrostatic latent image has been popular and means utilising a magnetic latent image has become more practical than before.

In these processes powdery toner is used to visualize the electrostatic or magnetic latent image by adhesion.

A particularly advantage toner composition for such use comprises, a vinyl resin represented by a styrene-acryl copolymer into which resin particles are mixed additives such as a colorant.

Copied or printed images obtained with the use of toner often have to be stored for a long period of time. For display, the copied or printed material which consists of a toner image formed on a paper support is often kept in a document holder made of resin sheet or laminated on one side or both sides thereof with a resin sheet.

When a toner image is stored in contact with such resin sheet, the toner of the image often adheres to the resin cover and comes off from the paper support when the cover is peeled off thereby injuring the printed or copied material.

OBJECT OF THE INVENTION

The object of the invention is to provide a toner which is capable of giving excellent development of a latent image and fixing the toner image without any special requirement. In addition, in the case where the toner image is stored in contact with a resin cover sheet, the toner image is resistant to adherence to the resin cover sheet.

SUMMARY OF THE INVENTION

The present invention specifically relates to toner for developing an electrostatic latent image which comprises (a) a polyester resin obtained by polymerizing a composition containing an alcohol monomer and a carboxylic acid monomer, at least one of said alcohol and carboxylic acid monomers containing a multifunctional component of not less than trivalence, and (b) an epoxy resin.

DETAILED DESCRIPTION OF THE INVENTION

In the present invention a polyester resin obtained by condensation polymerization of a composition containing an alcohol monomer and a carboxylic acid monomer, wherein at least one of said alcohol and carboxylic acid monomers contains a multifunctional monomer component of not less than tri-valence, and an epoxy resin are used as binder resins and, thereinto, necessary components such as a colorant are to be incorporated, thus to obtain the toner of the invention.

As for alcohols which constitutes the polimeric composition, diols including ethyleneglycol, diethyleneglycol, triethyleneglycol, 1,2-propyleneglycol, 1,3-propyleneglycol, 1,4-butanediol, neopentylglycol, 1,4-butenediol; 1,4-bis(hydroxymethyl)cyclohexane; etherified bisphenols including bisphenol A, hydrogenated bisphenol A, a polyoxyethylenified bisphenol A, a polyoxypropionized bisphenol; a divalent alcohol obtainable by substituting said divalent alcohols heretofore mentioned by a hydrocarbon group having 3 to 22 carbon atoms and the like; alcohols of tri- or more valences including sorbitol, 1,2,3,6-hexanetetraol, 1,4-sorbitan, pentaerythritol, di-pentaerythritol, tri-pentaerythritol, saccharose, 1,2,4-butanetiol, 1,2,5-pentanetiol, glycerol, 2-methylpropanetriol, 2-methyl-1,2,4-butanetriol, trimethylolethane, trimethylolpropane and 1,3,5-trihydroxymethylbenzene and the like can be mentioned.

As for carboxylic acid monomers maleic acid, fumaric acid, metaconic acid, citraconic acid, itaconic acid, glutaconic acid, phthalic acid, iso-phthalic acid, terephthalic acid, cyclohexane-di-carboxylic acid, succinic acid, adipic acid, sebacic acid, malonic acid, a divalent acid of heretoforementioned divalent organic acids monomers which is substituted by a saturated or unsaturated hydrocarbon group having 3 to 22 carbon atoms, a dimer of a lower alkylester and linolenic acid, 1,2,4-benzenetricarboxylic acid, 1,2,5-benzene tricarboxylic acid, 1,2,4-cyclohexanetricarboxylic acid, 2,5,7-naphthalenetri-carboxylic acid, 1,2,4-naphthalenetricaboxylic acid, 1,2,4-butanetricaboxylic acid, 1,2,4-haxanetricaboxylic acid, 1,3-dicarboxyl-2-methyl-2-methylenecarboxylic-propane, tetra(methylenecalboxylic)methane, 1,2,7,8-octane-tetracarboxylic acid, empol trimer acid, and acid anhydride of heretoforementioned organic acids can be mentioned.

It is preferable in the present invention that the component of multifunctional monomer of not less than trivalence is incorporated into the composition at a proportion of from 5 to 80 mol% relative to the total mol% of alcohol component and acid component respectively as the structural units of the polymer to be obtained.

The polyester resin thus obtained according to the present invention preferably has a softening point of from 100° C. to 160° C., for example, in terms of the measurement by flow tester method.

According to a more preferable embodiment of the present invention, the polyester resin has a softening point of from 110° to 150° C.

The softening point used in the present invention is defined as a half value of the height between the starting point of the flow-out and ending point of the flow-out when 1 $cm^3$ of sample resin is melted and flowed from a dice apparture of 1 mm under the condition of 20 $kg/cm^2$ of pressure and temperature-rising velocity of 6° C./min. measured by the use of a fallout flow tester "CFT-500" (manufactured by SHIMAZU CORPORATION).

As for the epoxy resin of the present invention although no specific limitation is made, according to the preferable embodiment of the present invention one having a melting point between 60° to 160° C., and more preferably, between 85° to 120° C. in terms of measurement by Dulon's mercury method, and a glass transition point of not less than 55° C. is used.

As most preferable example in accordance with the present invention that of bisphenol A type epoxy resin can be mentioned.

For example, those sold under the tradename of "EPICOAT", such as "1003", "1055", "1004", "1004F", "1004AF", "1005H", "1007" and "1009" (all manufactured by SCHELL-EPOXY LTD.); those sold under the tradename of "ARLDITE GY" such as "7072", "6084" and "6097" (all manufactured by CIBA-GEIGY LTD.) those sold under the tradename of "D.E.R." such as "662", "664", "667" and "668" (all manufactured by DOW CHEMICAL INTERNATIONAL INC.) can be mentioned.

The proportion of the epoxy resin to be incorporated into the toner of the present invention is preferably 10 to 90 weight% relative to the total binder resin of the toner and, more preferably, 40 to 80 weight%. Further, according to the most preferable embodiment of the invention the proportion is 50 to 70 weight%.

The toner of the present invention may optionally contain any additives for the purpose of improving its properties in addition to the above-mentioned polyester resin and epoxy resin.

According to one of the preferable embodiments of the present inventions, the toner of the present invention contains a compound which is capable of controlling the chargeability, which is herein referred to as "charge controlling agent". The charge controlling agent of the present invention includes positive charge controlling agents and negative charge controlling agents. As for examples for the positive charge controlling agents nigrosine dyes such as "Nigrosine Base EX", "Oil Black BS", "Oil Black SO" (these are products of Orient Chemicals Co., Ltd.), triphenylmethane-type dyes such as one having the following chemical formula,

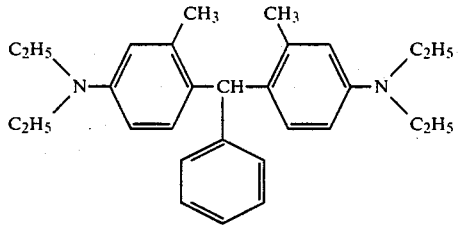

tertiaryammonium salts such as cetyl-tri-methyl ammonium bromide can be mentioned as representative examples.

The negative charge controlling agent includes, for example, azo dyes containing a metal such as "Varifast 3804" (product of Orient Chemicals Co., Ltd.), "Spiro Black TRH" (Hodogaya Chemical Co., Ltd.", Co-phthalocyanine dyes, metallic complexes of salicylic acid such as "Bontron E-81" and the like compounds.

The charge controlling agent may be contained in the toner composition at a proportion of 0.1 to 10% by weight, preferably 1 to 5% by weight relative to the binder resin.

According to another preferable embodiment of the present invention, the toner of the present invention contains one or more of so-called anti-offset agent.

As for the anti-offset agent following classes of compounds may be mentioned:

(i) Olefin polymers of low softening point:

The compounds of this class includes homopolymers or copolymers of the olefin which consists of at least one olefin monomer component, copoymers containing as its monomer component an olefin monomer and another monomer other than olefin and modified product therefrom, which polymers having relatively low molecular weight.

As for olefin monomers, any kinds of olefin may be mentioned, for example, ethylene, propylene, butene-1, pentene-1, hexene-1, heptene-1, octene-1, nonene-1, decene-1 or the isomer thereof such as 3-methyl-1-butene, 3-methyl-2-pentene, 3-propyl-5-methyl-2-hexene and the like, which have been introduced therein an alkyl group as a branch. As for nonomer components other than olefins, which form copolymers togerther with olefins, for example, vinylethers such as vinyl methyether, vinyl n-butylether, vinyl phenylehter; vinyl esters such as vinyl acetate, vinyl butylate; halo-olefins such as vinyl fluoride, vinylidene fluoride, tetrafluoroethylene, vinyl chloride, vinylidene chloride, tetrachloroethylene; acrylic acid esters or methacrilic acid esters such as methyl acrylate, ethyl acrylate, n-butyl acrylate, methyl methacrylate, n-butyl methacrylate, stearyl methacrylate, N,N-dimethylaminoethyl methacrylate, t-butylaminoethyl methacrylate; acryl-type derivatives such as acrylonitrile, N,N-dimethyl acrylamide; organic acids such as acrylic acid, methacrilic acid, maleic acid fumaric acid and itaconic acid; and other monomers such as diethyl fumalate, B-pinene, etc.

As for olefin copolymers, such as ethylene-propylene copolymer, ethylene-butene copolymer, ethylene-pentene copolymer, propylene-butene copolymer, propylene-pentene copolymer, ethylene-3-methyl-1-butene copolymer, ethylene-propylene-butene copolymer; ethylene-vinyl acetate copolymer, ethylene-vinyl methylether copolymer, ethylene-vinyl chloride copolymer, ethylene-methyl acrylate copolymer, ethylene-methyl methacrylate copolymer, ethylene-acrylic acid copolymer, propylene-vinyl acetate copolymer, propylene-vinyl ethylether copolymer, propylene ethyl acrylate copolymer, propylene-methacrylic acid copolymer, butene-vinyl methylether copolymer, pentene-vinyl acetate copolymer, hexene-vinyl butylate copolymer, ethylene-propylene-vinyl acetate copolymer, ethylene-vinyl acetate-vinyl methylether copolymer may be mentioned.

The modified compounds of these homopolymers or copolymers, in which a modifier is blocked or grafted to the polyolefins, may also be effective. Such modifier includes acrylate monomers, aromatic vinyl monomers or unsaturated carboxylic acids may be used. As for acrylate monomers, methyl acrylate, ethyl acrylate, n-butyl acrylate, iso-butyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl a-chloroacrylate, methyl methacrylate, ethyl methacrylate, propyl methacrylate, n-butyl methacrylate, iso-butyl methacrylate, n-octyl methacrylate, dodecyl methacrylate, lauryl methacrylate, 2-ethylhexyl methacrylate, stearyl methacrylate, phenyl methacrylate, dimethylaminomethyl methacrylate, diethylaminomethyl methacrylate and the like compounds.

By carrying out block polymerization or graft polymerization under conventional methods and conditions by the use of the acrylate monomer and the olefin waxes consisting of modified polyolefins may be obtained. For carrying out the block copolymerization, such a method as one using a living polymer or a method of reacting a radical derived from dividing mecha(nical)-chemically a wax with acrylate monomer, to obtain a block copolymer may be used.

For the completion of the graft copolymerization, a method wherein ozonized polyethylene is reacted with acrylte monomer(polymer starter method) or a method of graft-polymerization by the use of radioactive rays may also be utilised. As acrylate monomers which are useful as a modifier component methyl acrylate, methyl methacrylate, n-butyl methacrylate and the like compounds can be mentioned. As examples of aromatic vinyl monomers, 1-phenylpropene, styrene, o-styrene, m-styrene, m-methylstyrene, p-methylstylene, a-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene etc. may be mentioned.

The waxes made of the modified polyolefins may be obtained by graft-polymerizing or block-polymerizing under the conventionally known conditions with the use of the aromatic vinyl monomer and the polyolefin mentioned hereinbefore.

When an unsaturated carboxylic acid is used as a modifying component, maleic acid, fumaric acid, citraconic acid, methaconic acid, itaconic acid and the anhydride thereof, etc. may be used.

Preferably, the homopolymer, the copolymer or the modified polymer thereof of the olefin according to the present invention should have a low softening point of from 80° to 180° C., and more preferably 90° to 160° C., measured by the ring and ball method as defined in JIS K2531-1960.

As the preferable examples of polyalkylene resins which is available in the market, "Viscol 660P" and "Viscol 550P", which are products of Sanyo Chemical Industries, Ltd., may be mentioned.

(ii) Paraffin waxes of high melting point:

Paraffin waxes to be advantageously used in the present invention are those having good compatibility with the polyester resin of the present invention and those having relatively high melting point (70° to 160° C.) are preferable. As for such waxes having relatively high menlting point, for example, as a natural wax, microwax can be mentioned and, as a synthesis one, Fischer-Tropsche Wax can be mentioned and the oxidized or saponified products thereof may also be used.

As the example of such waxes having high melting point which are available in the market the following class may be mentioned:

"Sazole Wax H1" (Sazole Marketting Co.),
"Sazole Wax A1" (Sazole Marketting Co.),
"Sazole Wax A2" (Sazole Marketting Co.),
"Microcrystalline Wax #220" (Mobil Oil Co.),
"170° Microparaffin" (Nippon Oil Co., Ltd.),
"Santite A", "Santite B" and "Santite C" (Seiko Chemical Co.),
"22-Tritetracontanon" (Tokyo Kasei Co.),
"135° Paraffin", "1-Goubetsu Paraffin" and "150° Microparaffin" (Nippon Oil Co., Ltd.),
"Shell 135° Parafin Wax" (Shell Oil Co.),
"Hart Wax", "Gleitmittel-KO" (made in West Germany),
"Amble Wax" (Hodogaya Chemical Co., Ltd.)

(iii) Liquid Paraffins:

The compounds of this class includes saturated or unsaturated paraffins which are of liquid-like under the room temperature. Momt of such paraffins available in the market contains as the main component thereof a saturated paraffin and unsaturated paraffin is incorporaed thereinto at some proportion.

Examples of liquid paraffins of this class made available includes following products:

"Unico H-150", "Unico H-160", "Unico H-260", "Unico H-350" (Union Oil Co.),
"Crystol-355" (Esso Standard Oil Co.),
"Smoil P-350" Matsumura Oil Co.),
"Dafney Oil CP-50" (Idemitsu Kosan Co., Ltd.)

(iv) Silicone Varnish:

As for examples of this class methylsilicone varnish, phenylsilicone varnish, etc. may be mentioned.

(v) Aliphatic Fluorocarbon Compounds:

As for examples of this class polymers of low polymerization degree of tetrafluoroethylene, hexafluoropropylene, etc. may be mentioned.

(vi) Aliphatic Acid Esters or Partial Saponification Produducts Thereof:

The compounds of this class includes those aliphatic acid esters or a partial saponification product thereof having a melting point of about 30° to 130° C. and they are those esters or partial saponification products thereof obtained by the reaction of a saturated or unsaturated aliphatic acid with a saturated or unsaturared aliphatic alcohol or by partially saponifying thus obtained ester with a hydroxide of sodium, calcium, magnesium, lead, aluminium, barium, zinc and the like. As for the aliphatic acid may be either lower or higher acid and they include, for example, valeric acid, caproic acid, enanthic acid, caprylic acid, pelargonic acid, capric acid, undecilic acid, lauric acid, trideciylic acid, myristic acid, pentadecylic acid, palmitic acid, margaric acid, stearic acid, nondecylic acid, arachic acid, behenic acid, lignoceric acid, cerotic acid, montanic acid, melissic acid, hentriacontanic acid, dotriacontanic acid, tetratriacontanic acid, hexatriacontanic acid, octatriacontanic acid, lindelic acid, lauroleic acid, myristoleic acid, zoomaric acid, petrocelinic acid, oleic acid, elaidic acid, gadoleic acid, brassidic acid, linolic acid, linolenic acid, eleostearic acid, linoelaidic acid, valinalinic acid, glutaric acid, adipic acid, azelaic acid, sebacic acid, suberic acid, pimeric acid, arachdonic acid, and other dicarboxylic acid having therein 9 to 19 methylene groups can be mentioned. And as for the aliphatic alcohols, which are another law material component, lower or higher alcohols which may be either of monovalent or multivalent, for example, methyl alcohol, ethyl alcohol, propyl alcohol, butyl alcohol, amyl alcohol, caproil alcohol, capryl alcohol, capryryl alcohol, lauryl alcohol, myristiryl alcohol, cetyl alcohol, stearyl alcohol, arachidic alcohol, behenyl alcohol, carnaubyl alcohol, cerryl alcohol, myricyl alcohol, melissyl alcohol, lacceryl alcohol, allyl alcohol, crotyl alcohol, 2-butenol-1, 2-pentenol-1, 3-hexenol-1, 2-heptenol-1, 10-undecenol-1, 11-dodecenol-1, 12-tridecenol-1, oleil alcohol, elaidyl alcohol, linoleil alcohol, linolenyl alcohol, ethylene glycol, propylene glycol, trimethylene glycol, 1,3-butanediol, 1,4-butanediol, 2,3-butanediol, 2-butene-1,4-diol, 1,5-pentanediol, 2,4-pentanediol, 1,6-hexanediol, 2,5-hexanediol, 2-methyl-1,3-pentanediol, 2,4-heptanediol, 2-ethyl-1,3-hexanediol, 2-ethyl-2-butyl-1,3-propanediol, hexadecane-1,2-diol, octadecane-1,2-diol, eicosane-1,2-diol, dosacon-1,2-diol, tetraconsane-1,2-diol, diethylene glycol, triethylene glycol, tetraethylene glycol, dipropylene glycol, glycerin, pentaerythritol, sorbitol, etc. may be mentioned.

In the present invention when either of the aliphatic acid or the aliphatic alcohol is of a lower acid or alcohol, the other one is a higher acid or alcohol is preferable, i.e., among esters made from aliphatic acids and aliphatic alcohols mentioned above, those having 5 or more of carbon atoms as acid and those having total carbon atoms of more than 20 in the esters can give preferable results in the present invention.

In the present invention, these aliphatic acid esters or the partial saponification products thereof may used singly or in the combination of two or more of aliphatic esters or alipphatic esters and the partial saponification products thereof.

Such aliphatic esters or partial saponification products or combinations thereof are available in the market and representative examples are given below:

Lower alcohol ester of aliphatic acid:

"Butylstearate" (Kawaken Fine Chemical Co.),
"ButylStearate" "Kao Soap Co., ltd.)

Multivalent alcohol ester of aliphatic acid:

"Nissan Caster Wax A" (Glycerol-tri-1,2-hydroxystearate, Nippon Oil and Fats Co., Ltd.)
"Diamond Wax" (Sin Nippon Rika Co., Ltd.)
"Hima Kou" (Kawaken Fine Chemical Co.)

Higher alcohol ester of aliphatic acid ester:

"Spermacetti" (cetyl parmitate, Nippon Oil Oil and Fats Co., Ltd.)
"Hoechst Wax E" (ethyleneglycol seter of montanic acid, Hoechst Japan Co. Ltd.)
"Hoechst Wax OP" (partial saponification product of butylene glycol ester of montanic acid, Hoechst Japan Co., Ltd.)

Partial ester of multivalent alcohol and aliphatic acid:

"Monoglee-M" (alpha-glycelol monostearate, Nippon Oil and Fats Co., Ltd.)
"Aliphatic acid monoglyceride R-60" (stearic acid monoglyceride, Matumoto Yushi Seiyaku Co., Ltd.)
"Aliphtic acid monoglyceride R-80" (Oleic acid-stearic acid-monoglyceride, Matsumoto Yushi Seiyaku Co., Ltd.)
"RIKEMAL-S-200" (glycerine stearate, Riken Vitamin Oil Co., Ltd.)
"RIKEMAL-B-100" (glycerine monobehenate, Riken Vitamin Oil Co., Ltd.)
"RIKEMAL-S-300" (sorbitan monostearate, Riken Vitamin Oil Co., Ltd.)
"RIKEMAL-PS-100" (propylene glycol monostearate, Riken Vitamin Oil Co., Ltd.)
"ATMUL-T-95" (high purity of monoglyceride, Kao Atlas Co., Ltd.)

Mixed esters:

"VLTN-4" (Kawaken Fine CHemical Co.)
"VLT-L" (Kawaken Fine Chemical Co.)
"K-3 Wax" (Kawaken Fine Chemical Co.)
"Rice Wax" (Noda Wax Co., Ltd.)

Further thereto "Carnauba Wax", "Candelira Wax Special No.", "Candelira Wax No. 1" and "Candelira Wax No. 2" (all manufactured by Noda Wax Co., Ltd.) may also be used preferably in the present invention.

(vii) Alkykene-bis-aliphatic acid amides:

This class of compounds includes those having a melting point of 100° to 180° C., for example, following compounds may be mentioned:

$C_{10}H_{21}CO-NH-(CH_2)_5-NH-OCC_{10}H_{21}$ 1.

$C_{11}H_{21}CO-NH-(CH_2)_4-NH-OCC_{11}H_{23}$ 2.

$C_{13}H_{27}CO-NH-(CH_2)_2-NH-OCC_{13}H_{27}$ 3.

-continued $C_{10}H_{21}CO-NH-(CH_2)_3-NH-OCC_{14}H_{29}$ 4.

$C_{15}H_{31}CO-NH-(CH_2)_2-NH-OCC_{15}H_{31}$ 5.

$C_{17}H_{35}CO-NH-CH_2-NH-OCC_{15}H_{31}$ 6.

$C_{17}H_{35}CO-NH-(CH_2)_2-NH-OCC_{15}H_{31}$ 7.

$C_{23}H_{47}CO-NH-CH_2-NH-OCC_{15}H_{31}$ 8.

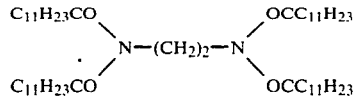

9.

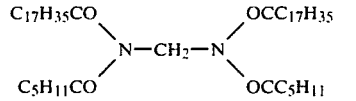

10.

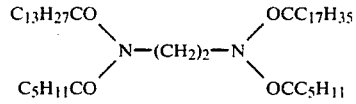

11.

$C_{21}H_{41}CO-NH-CH_2-NH-OCC_{21}H_{41}$ 12.

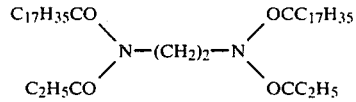

13.

$C_{17}H_{35}CO-NH-(CH_2)_2-NH-OCC_{17}H_{31}$ 14.

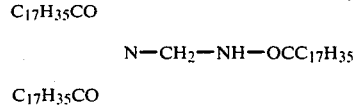

15.

As for alkylenebisamide compounds available in the market, the followings may be mentioned.

"BISAMIDE" (Nitto Chemical Ind., Co., Ltd.),
"PLASTFLOW" (Nitto Chemical Ind., Co., Ltd),
"DIADD 200BIS" (Nippon Hydrogen Co., Ltd.),
"LUBRON E" (Nippon Hydrogen Co., Ltd.),
"ALFLOW H50S" (Nippon Oil and Fats Co., Ltd.),
"ALFLOW V-60" (Nippon Oil and Fats Co., Ltd.),
"AMIDE 6-L" (Kawaken Fine Chemical Co.),
"AMIDE 7-S" (Kawaken Fine Chemicak Co.),
"ARMOWAX-EBS" (Lion-Armer Co.),
"Hoechst Wax C" (Hoechst),
"Nobuko Wax-22DS" (Nobuko Chemical Co.,),
"Adva Wax-280" (Advance Co.,),
"Kao Wax-EB" (Kao Soap Co., Ltd.),
"Parycin-285" (Baker-Caster Oil Co.),

(viii) Higher Aliphatic acid:

As higher aliphatic acids lauric acid, mirystic acid, palmitic acid, staeric acid, oleic acid, linolic acid, arachidic acid, behenic acid, lignoceric acid, selacholeic acid or a mixture thereof may be mentioned. As for those available in the market, "F-3" AND "VLZ-200" (Kawaken Fine Chemical Co., Ltd.), "Power Stearic Acid", "Gyushi Kyokudo" and "NAA 222", "NAA 221" (Nippon Oil and Fats Co., Ltd.), "Lunac S-40", "Lunac S-90", "lunac S-30", "Lunac 8-55", "Lunac 8-95", "Lunac 10-95", "MY-85", "MY-95", "P-85", "P-95", "S-10", "S-20", "T-S-4", "T-S-2", "T-D-2", "T-D-4", "Kao Wax M-80", "Kao Wax 85-Powder", "Kao Wax 85-Powder", "Kao Wax SS" (all pdoducts of Kao Soap Co., Ltd.) and the like may be mentioned.

(ix) Metallic salt of aliphatic acid:

As for the examples of this class, zinc, cadmium, barium, lead, iron, nickel, cobalt, copper, aluminium, magnesium or the like-metal salt of stearic acid, dibasic lead salt of stearic acid, metallic salt of oleic acid such as zinc, magnesium, iron, cobalt, copper, lead, calcium, and the like metal salt, meal salt of palmitic acid like of aluminum or calcium, lead salt of caprylic acid, lead salt of caproic acid, zinc or cobalt salt of linolic acid, calcium, zinc or cadmium salt of recinoleic acid, and a mixture thereof may be mentioned.

(x) Higher alcohols:

Higher alcohol may either be primary alcohol or alcohol of higher valencies. For example, lauryl alcohol, mirystiryl alcohol, palmityl alcohol, stearyl alcohol, arachidic alcohol, behenyl alcohol, etc. may be mentioned. As for those available in the market "Kalcohol 08", "Kalcohol 10", "Kalcohol 20", "Kalcohol 24", "Kalcohol 40", "Kalcohol 42", "Kalcohol 60", "Kalcohol 68", "Kalcohol 80", "Kalcohol 86", "Kalcohol 468", "Kalcohol 524", "Kalcohol 624" (all of these are products of Kao Soap Co., Ltd..) and the like may be mentioned.

(xi) Fluorine-containing surface active agent:

As for the example of this class such compounds disclosed in Japanese Patent O.P.I. Publication No. 124428/1980 may be mentioned.

According to the preferable example of the present invention, one or more kinds of anti-offset agent heretofore mentioned can be used and, especially, a mixture of amide series wax with at least one class of compound selected from (i) olefin waxes, (ii) Ester series waxes, (iii) higher aliphatic acid, (iv) higher alcohol and (v) metal salts of aliphatic acid is advantageous.

The proportion of the anti-offset agent to be incorporated in the toner composition is preferably 1 to 25% by weight, and more preferably 2 to 10% by weight relative to the total amount of resin of the roner.

As for the colorant used for the present invention, any conventionally known colorants and such colorant includes carbon black, Nigrosine(C.I. No. 50415B), Aniline Blue(C.I. No. 50405), Ultranarine Blue(C.I. No. 77103), Chrome Yellow(C.I. No. 14090), Quiniline Yellow(C.I. No. 47005), Rose Bengal(C.I. No. 45435), Du Pont Oil Red(C.I. No. 26105), Phthalocyanine Blue(C.I. No. 74160), Lamp Black(C.I. No. 77266), etc. and a mixture thereof may be used. The amount of the colorant to be incorporated into the toner of the present invention may not be limited but, in general, 1 to 20 parts by weight relative to 100 parts of the binder resin may be preferable.

In the case where toner of the present invention is applied to a so-called one-component toner, a magnetic material may be incorporated into the toner composition instead of, or together with the colorants. The magnetic material that may be used includes a compound or an alloy containing therein a ferromagnetic element such as iron, cobalt and nickel; ferrite, magnetite; such an alloy as so-called Heusler's alloy which contain manganese and copper in the alloy, like Mn-Co-Al or Mn-Co-Sn, and whhich does not contain magnetic element but turns to show a ferromagnetic nature under suitable treatment by heat; or cromium dioxide, etc. may be mentioned.

These magnetic materials are usually incorporated into and uniformely dispersed in the the toner composition in the form of a fine powder of the average particle size of 0.1 to 1 micron. The amount of the magnetic material to be incorporated is generally 20 to 70 parts by weight relative to 100 parts by weight of toner and, preferably, at a proportion of 40 to 70 parts by weight relative to the same.

According to the present invention, as understood by the examples hereinafter given, toner having an excellent developability and fixability can be obtained. Further the toner of the present invention can give a toner image having good image quality. Still further, the toner of the present invention can give a toner image having a improved preservability against resin material and thus even when such toner image are restored in touch with a resin film or sheet cover the toner image will be kept in good condition without being adversely effected by the resin.

To be more detail, although a polyester resin has relatively strong chargeability in the negative polarity, its negative chargeability is weakened by being mixed with an epoxy resin, to make the total chargeability of the toner to be moderate in the negative. As the result thereof, it becomes possible, by the use of the toner of the present invention with, for example, adequately selected carrier or by adequately selecting a charge controlling agent to be incorporated into the toner composition, for the toner of the present invention to be advantageously used for the development of the electrostatic latent image of the either polarity, e.g., for the development of a positively charged electrostatic latent image, for the development of the electrostatic image formed by a negative charge, or for carrying out reveresal development of a positive electrostatic latent image formed on a seleniun photo-receptor, which has excellent photoconductive properties, as in the laser printer.

Toner, in which a polyester resin is used as binder resin, can generally become fixable at relatively low temperature as the polyester resin usually has low softening point. The toner of the present invention has such advantage that, since the polyester resin used in the present invention is one obtained from a monomer composition containing a multi-functional monomer component, the resulting polymer being considered to have lots of cross-linkages in its molecule, it becomes less likely to cause an off-set phenomenon during fixing operation even with a rein of low softening point and, further, with the use of an epoxy resin.

Accordingly, following the present invention high speed fixation of a toner image with reduced energy becomes possible by the use of heat roll fixing method, which itself are known to be advantageous.

According to the present invention, quite distinctive from the case where the toner of the prior art is used, toner image having improved durability will be obtainable. It is assumed that resin cover usually used for the restoration of the toner image is made of polyvinyl chloride or a copolymer thereof and contains as an essential additive a plasticizer. The toner of the present invention, containing polyester resin and epoxy resin in combination and the polyester resin having closs-linking structure in the molecule, is assumed not to be adversely affected by such plasticizer contained in the resin cover.

The toner of the present invention is made to be a developer for developing a electrostatic or electromagnetic latent image by being mixed with carrier or, when magnetic material is contained therein, by itself.

Further, according to the most preferable embodiment of the present invention minimum fixing temperature can be reduced by the use of an anti-offset agent and, therefore, toner of the present invention is advantageousy used for a system in which image production at a higher speed is required. In addition thereto, when an amide series wax is used in combination with other materials (i) to (v) listed hereinbefore, such advantages that the fixability of the toner image will further be improved as well as its durability.

Present invention is further explained with the reference to examples, however, of course, the scope of the invention is not limited by them.

SYNTHESIS EXAMPLE I

A round bottomed flask equipped with a thermometer, a stainless steel stirrer, a glass tube through which to introduce nitrogen and a condenser was charged with 299 g of telephthalic acid 211 g of polyoxypropylene(2,2)-2,2-bis(4-hydroxy phenyl)propane and 82 g of pentaerythritol. The flask was set in a mantle heater and heated while nitrogen gas was introduced into the flask to keek its interior under an inert atomosphere. Then, 0.05 g of dibutyl tin oxide was added, and reduction was carried out at 200° C. while the softening point was used as a parameter to monitor the progress of the reaction. As a result, polyester resin A having a softening point of 134° C. (by the use of Floetester) was obtained.

SYNTHESIS EXAMPLE II

Polyester B having softening point of 136° C. was synthesizes in the same manner as in SYNTHESIS EXAMPLE I provided that 299 g of isophthalic acid instead of telephthalic acid and 74 g of glycerol instead of pentaerythritol were used and the reaction was carried out at a temperature of 180° C.

EXAMPLE I

Following components were premixed by Henschel Mixer for 15 minutes and thereafter melted and kneaded by using a double-axis extruder. After cooling the mixture to the room temperature and solidifying it, the resultant was prepulverized by using a hammer mill and further pulverised to a fine powder by the use of I-type mill. The fine powder thus obtained was classified by a wind force classifier to obtain a toner having average particle size of 12 to 13 microns. In the toner composition in this and following examples, given numbers are used in terms of parts by weight.

| TONER COMPOSITION | |
|---|---|
| Polyester Resin A | 40 |
| Epoxy Resin "EPICOAT 1004F" (Softening Point 97° C.) | 60 |
| Carbon Black "MOGAL L" (Product of Cabot Co.) | 5 |

Various kinds of toner were prepared in the same manner as in Example I provided that following toner compositions given in Examples II to IV and Comparative Examples I to III were used.

EXAMPLE II

| | |
|---|---|
| Polyester Resin B | 40 |
| Epoxy Resin "EPICOAT 1004F" | 60 |
| Carbon Black "MOGAL L" | 5 |

EXAMPLE III

| | |
|---|---|
| Polyester Resin A | 40 |
| Epoxy Resin "EPICOAT 1007" (Softening Point 118° C.) | 60 |
| Carbon Black "MOGAL L" | 5 |

EXAMPLE IV

| | |
|---|---|
| Polyester Resin A | 20 |
| Epoxy Resin "EPICOAT 1004F" | 80 |
| Carbon Black "MOGAL L" | 5 |

COMPARATIVE EXAMPLE I

| | |
|---|---|
| Chained Polyester Resin A "ATLAC 382A" (Softening Point: 93° C., Product of ATLAS CO.,) | 40 |
| Epoxy Resin "EPICOAT 1004F" | 60 |
| Carbon Black "MOGAL L" | 5 |

COMPARATIVE EXAMPLE II

| | |
|---|---|
| Polyester Resin A | 100 |
| Carbon Black "MOGAL L" | 5 |

COMPARATIVE EXAMPLE III

| | |
|---|---|
| Epoxy Resin "EPICOAT 1007" | 100 |
| Carbon Black "MOGAL L" | 5 |

1.5 g of the respective toner thus obtained and 58.5 g of carrier coated with 1,1-dihydroperfluoromethylmethacrtlate, which carrier has the average particle size of about 100 microns, were mixed in a vibrater for 20 minutes and, then, the amount of charge given to the toner was measured by the Blow-off method in terms of Q/M (micro coulombs/g). Also, softening point of the toner was measured by Flowtester method.

Further, 2.5 parts by weight of the respective toner and 97.5 parts by weight of the above-mentioned resin coated carrier was mixed to prepare a developer. Then with the use of thus prepared developer the temperature at which the off-set phenomenon is observed was measured by the use of an electrophotographic copying machine, i.e., a modified "U-Bix 2500" (Product of Konishiroku Photographic Co., Ltd.), which is installed with a heat roll fixing unit consisting of a heat roll, the surface of which is formed of TEFLON (polytetrafluoroethylene produced by du Pont), and a pressure roll, the surface of which is formed of a silicone rubber "KE-1300 RTV" (product of Shinetsu Chemical Industry Co., Ltd.), without a oil providing unit for the prevention of the off-set, the line-feeding speed of said unit being fixed at 350 mm/sec, and which was installed with an organic photoconductive drum. The off-set phenomenon was measured by, first, developing an electrostatic image formed in an ordinary electrophotographic method with a developer and, transferring the toner image onto a plain paper sheet and fixing the transferred image in the above-mentioned fixing unit, and, thereafter, by passing a white paper through the fixing unit under the same conditions, to observe if any contamination is seen on the surface of the white paper due to the toner attached to the roll in the fixing unit. By repeating above-mentioned operation at various temperatures, the temperature, at which off-set phenomenon is first seen was obtained.

Further, repeated copying test was carried out at a fixing temperature of 180° C. and the degree of occurrence of fog was determined by the use of the obtained image.

Still further, by rubbing the image portion of the thus obtained toner image with "JK Wiper" (Product of Jujo Kimberley Co.) to determine the degree of easiness of the toner to come off.

Still further, the printed paper with the toner image formed by the above-mentioned repeated copying test was left under a cover sheet made of polyvinyl chloride resin, which is easily available in the market, with a load of 100 g and under a temperature of 70° C. for three hours and, thereafter, the printed material was peeled off from the sheet to determine the degree of transfer of the toner from the material to the sheet and thereby the durability the toner against resin was determined.

The results are given in TABLE I, wherein "A" stands for "No occurrence of the transfer of the toner was observed", "B" stands for "Occurrence of the transfer of the toner was observed" and "X" stands for the ocuurence of off-set phenomenon at every varied fixing temperature.

TABLE I

| Example No. | Q/M | Softening point | Minimum temperature at which off-set was observed | Durability against resin | Fog | Fixability |
|---|---|---|---|---|---|---|
| Invention | | | | | | |
| I | +22.2 | 114.5° C. | 200° C. | A | None | Good |
| II | +18.2 | 116.0 | 200 | A | None | Good |
| III | +19.9 | 123.5 | 200 | A | None | Good |
| IV | +24.5 | 104.0 | 195 | A | None | Good |
| Comparison | | | | | | |
| I | 11.6 | 95.0 | X | B | Slightly | Good |
| II | +8.9 | 130.5 | 200 | A | Occurred | Bad |
| III | +28.3 | 118.0 | X | A | None | Good |

EXAMPLES V TO XII and COMPARATIVE EXAMPLES IV to VII

In these Examples the similar tests as in Example I were repeated provided that in these Examples as for toner compositions those listed in Table II were used, that for the determination of the amount of cgarge, 3 g of toner and 57 g of iron particles "EFV-3" (product of Nihon Teppun Co., Ltd.) were used and that for the detemination other properties using a copying machine sperical iron powder "100M-1" (product of Shinto Brater Co.) instead of the resin coated carrier of Example I.

TABLE II

| Example No. | Resins Used: Polyester Resin | Resins Used: Epoxy Resin | Proportion of Resins in Terms of Parts by Weight Ex/Ep | Coloring Agent (5 parts by weight) | Charge Controlling Agent (3 parts by weight) |
|---|---|---|---|---|---|
| V | A | 1004F | 40/60 | CB | EX |
| VI | B | 1004F | 40/60 | CB | EX |
| VII | A | 1007 | 40/60 | CB | EX |
| VIII | A | 1004F | 40/60 | CB | BS |
| IX | A | 1009F | 20/80 | CB | BS |
| IX | A | 1009F | 20/80 | CB | BS |
| X | A | 1009F | 20/80 | CB | TRH |
| XI | A | 1009F | 20/80 | CB | 3804 |
| XII | A | 1009F | 20/80 | CB | E-81 |
| Comparative | | | | | |
| IV | Y | 1004F | 40/60 | CB | EX |
| V | A | — | — | CB | EX |
| VI | — | 1007 | — | CB | EX |
| VII | A | 1004F | 20/80 | CB | EX |

In Tables II and IV, symbols used stand for as follows:

A: Polyester Resin A
B: Polyester Resin B
Y: ATLAC 382A
1004F: EPICOAT 1004F
1007: EPICOAT 1007F
1009F: EPICOAT 1009F
Es/Ep: Polyester Resin/Epoxy Resin
EX: Nigrosine Base EX
BS: Oil Black BS
TRH: Spiron Black TRH
3804: Varifast 3804
E-81: Bontron E-81
CB: Carbon Black(MOGAL L)

Results obtained are given in TABLE III.

TABLE III

| Example No. | Q/M | Minimum temperature at which off-set was observed | Durability against resin | Fog | Fixability |
|---|---|---|---|---|---|
| Invention | | | | | |
| V | +22.2 | 200° C. | A | None | Good |
| VI | +20.4 | 200 | A | None | Good |
| VII | +20.1 | 200 | A | None | Good |
| VIII | +23.5 | 200 | A | None | Good |
| IX | +25.1 | 195 | A | None | Good |
| X | −21.8 | 195 | A | None | Good |
| XI | −20.6 | 195 | A | None | Good |
| XII | −20.1 | 195 | A | None | Good |
| Comparison | | | | | |

TABLE III-continued

| Example No. | Q/M | Minimum temperature at which off-set was observed | Durability against resin | Fog | Fix-ability |
|---|---|---|---|---|---|
| IV | +24.5 | X | B | None | Good |
| V | +16.8 | 205 | A | Slight | Bad |
| VI | +21.7 | X | A | None | Good |
| VII | −8.2 | 200 | A | Occurred | Good |

EXAMPLES XIII to XXIX and COMPARATIVE EXAMPLES VIII to XI

In these Examples the same tests as in Example I using a electrophoto coppying machine were repeated provided that in these Examples as for toner compositions those listed in TABLE IV were used. Further in these Examples 5 parts by weight of "MOGAL L" was used as a colorant.

TABLE IV

| Example No. | Resins Used: Polyester Resin | Resins Used: Epoxy Resin | Proportion of Resins in Terms of Parts by Weight Es/Ep | Anti-Offset Agent Used (4 parts by weight) |
|---|---|---|---|---|
| XIII | A | 1004F | 40/60 | Polypropylene ("Viscol 550P") |
| XIV | B | 1004F | 40/60 | Modified Polyolefin (Block Copolymer of polyethylene and acrylate monomer) |
| XV | A | 1007 | 40/60 | Modified Polyolefin (styrene-modified polyethylene) |
| XVI | A | 1004F | 40/60 | Paraffin of high melting point ("Sazole Wax H1") |
| XVII | A | 1004F | 40/60 | Liquid Paraffin ("Unico H-150") |
| XVIII | A | 1004F | 40/60 | Silicone Varnish (polydimethyl siloxane) |
| XIX | A | 1004F | 40/60 | Aliphatic Fluorocarbon (vinylidene fluoride copolymer) |
| XX | A | 1004F | 40/60 | Ester("Hoechst Wax OP") |
| XXI | A | 1004F | 40/60 | Ester(Carnauba Wax) |
| XXII | A | 1004F | 40/60 | Amide("Hoechst Wax C") |
| XXIII | A | 1004F | 40/60 | Higher Aliphatic Acid (stearic acid) |
| XXIV | A | 1004F | 40/60 | Metal Salt of Aliphatic Acid(zinc salt of stearic acid) |
| XXV | A | 1004F | 40/60 | Higher Alcohol ("Kalcohol") |
| XXVI | A | 1004F | 40/60 | Fluorine-containing Surface Active Agent ("Fluorade FC-134") |
| XXVII | A | 1004F | 40/60 | "Hoechst Wax C" and "Viscol 550P" |
| XXVIII | A | 1004F | 40/60 | "Hoechst Wax C" and Carnaoba Wax |
| XXIX | A | 1004 | 40/60 | "Hoechst Wax C" and "Hoechst Wax OP" |
| Comparative | | | | |
| VIII | Y | 1004F | 40/60 | "Viscol 550P" |
| IX | A | — | — | "Viscol 550P" |
| X | — | 1007 | — | "Viscol 550P" |

TABLE IV-continued

| Example No. | Resins Used: Polyester Resin | Resins Used: Epoxy Resin | Proportion of Resins in Terms of Parts by Weight Es/Ep | Anti-Offset Agent Used (4 parts by weight) |
|---|---|---|---|---|
| XI | A | 1004F | 40/60 | — |

Results obtained are shown in TABLE V.

TABLE V

| Example No. | Minimum temperature at which off-set was observed | Durability against resin | Fix-ability |
|---|---|---|---|
| Invention | | | |
| XIII | More than 240° C. | A | Good |
| XIV | " | A | " |
| XV | " | A | " |
| XVI | " | A | " |
| XVII | " | A | " |
| XVIII | " | A | " |
| XIX | 230° C. | A | " |
| XX | More than 240° C. | A | " |
| XXI | " | A | " |
| XXII | 230° C. | A | " |
| XXIII | 225° C. | A | " |
| XXIV | " | A | " |
| XXV | " | A | " |
| XXVI | " | A | " |
| XXVII | More than 240° C. | A | Very Good |
| XXVIII | " | A | Very Good |
| XXIX | " | A | Very Good |
| Comparative | | | |
| VIII | X | B | Good |
| IX | More than 240° C. | A | Bad |
| X | X | A | Good |
| XI | 195° C. | A | Fair |

We claim:

1. A dry powder toner for developing an electrostatic latent image comprising a binder resin which comprises (a) a polyester resin obtained by polymerizing a composition containing an alcohol and a carboxylic acid, at least one of said alcohol and said carboxylic acid being a multifunctional component having at least three valence bonds and (b) an epoxy resin in an amount of from 40% to 80% by weight relative to the whole binder resin.

2. The toner of claim 1, wherein said alcohol is selected from a group consisting of divalent alcohols and trivalent alcohols.

3. The toner of claim 1, wherein said carboxilic acid is selected from a group consisting of mutivalent organic acid monomers and anhydrides thereof.

4. The toner of claim 1, wherein said polyester resin has a softening point of from 100° C. to 160° C. measured by the flowtester method.

5. The toner of claim 4, wherein said polyester resin has a softening point of from 110° C. to 150° C.

6. The toner of claim 1, wherein said epoxy resin has a melting point of from 60° C. to 160° C. measured by Dulong's mercury mehtod.

7. The toner of claim 6, wherein said epoxy resin has a melting point op from 110° C. to 150° C.

8. The toner of claim 1, wherein said epoxy resin is contained at a proportion of from 50% to 70% by weight relative to the whole binder resin.

9. The toner of claim 1, wherein said alcohol is selected from a group consisting ethyleneglycol, diethyleneglycol, triethyleneglycol, 1,2-propyleneglycol, 1,3-propyleneglycol, 1,4-butanediol, neopentylglycol, 1,4-butenediol, 1,4-bis(hydroxymethyl)cyclohexane, bisphenol A, hydrgenated bisphenol A, a polyoxyethylenified bisphenol A, a polyoxypropionized bisphenol, a divalent alcohol obtainable by substituting said divalent alcohols by a hydrocarbon group having 3 to 22 carbon atoms, sorbitol, 1,2,3,6-hexanetetrol, 1,4-sorbitan, pentaerythritol, dipentaerythritol, tri-pentaerythritol, saccharose, 1,2,4-butanetiol, 1,2,5-pentanetiol, glycerol, 2-methyl-propanetriol, 2-methyl-1,2,4-butanetriol, trimethylolethane, trimethylolpropane and 1,3,5-trihydroxymethylbenzene.

10. The toner of claim 1, wherein said carboxylic acid is selected from a group consisting of maleic acid, fumaric acid, metaconic acid, citraconic acid, itaconic acid, glutaconic acid, phthalic acid, iso-phthalic acid, terephthalic acid, cyclohexane-di-carboxylic acid, succinic acid, adipic acid, sebacic acid, malonic acid, a divalent acid herein-mentioned which is substituted by a saturated or unsaturated hydrocarbon group having 3 to 22 carbon atoms, a dimer of a lower alkylester and linolenic acid, 1,2,4-benzenetricarboxylic acid, 1,2,5-benzene tricarboxylic acid, 1,2,4-cyclohexanetricarboxylic acid, 2,5,7-naphthalenetricarboxylic acid, 1,2,4-naphthalenetricaboxylic acid, 1,2,4-butanetricarboxylic acid, 1,2,4-butanetricaboxylic acid, 1,2,4-hexane tricaboxylic acid, 1,3-dicarboxyl-2-methyl-2-methylenecarboxylicpropane, tetra(methylenecalboxylic)methane, 1,2,7,8-octanetetracarboxylic acid, empol trimer acid, and acid anhydride thereof.

11. The toner of claim 1, wherein said toner contains an anti-offset agent.

12. The toner of claim 11, wherein said anti-offset agent is selected from a wax of amides, olefins, esters, higher fatty acids, higher alcohols and metal salt of higher fatty acids.

13. The toner of claim 1, wherein said toner contains a charge-controlling agent.

* * * * *